US006135002A

United States Patent [19]

Neal

[11] Patent Number: 6,135,002

[45] Date of Patent: Oct. 24, 2000

[54] DIE CUTTER BLANKET AND BEARING AND METHOD OF ARRANGING THE BLANKET AND BEARING ON AN ANVIL

[76] Inventor: Kenneth Ray Neal, 9219 Sendera Dr., Magnolia, Tex. 77354

[21] Appl. No.: 09/066,924

[22] Filed: Apr. 27, 1998

[51] Int. Cl.[7] ..... B26D 7/20

[52] U.S. Cl. ..... 83/659; 83/347; 83/13; 492/40; 492/48

[58] Field of Search ..... 83/659, 658, 347, 83/13; 492/40, 45, 48

[56] References Cited

U.S. PATENT DOCUMENTS

| | | | |
|---|---|---|---|
| 172,393 | 1/1876 | Cossitt | 83/659 |
| 179,399 | 7/1876 | Clark | 492/40 |
| 202,992 | 4/1878 | Clark | 492/40 |
| 277,154 | 5/1883 | Osborne | 492/40 |
| 896,000 | 8/1908 | Forsyth | 492/45 |
| 1,052,403 | 2/1913 | Becker, Jr. | 492/40 |
| 1,281,003 | 10/1918 | Henderson | 492/40 |
| 1,671,522 | 5/1928 | Furbush | 492/45 |
| 1,771,784 | 7/1930 | Grupe | 492/45 |
| 3,012,419 | 12/1961 | Dovey | 464/51 |
| 3,285,642 | 11/1966 | Sauer | 83/659 |
| 3,577,822 | 5/1971 | Sauer et al. . | |
| 3,602,970 | 9/1971 | Smith | 83/347 |
| 3,604,302 | 9/1971 | Smythe | 83/347 |
| 3,633,246 | 1/1972 | Kirkpatrick | 83/659 |
| 3,677,122 | 7/1972 | Rautine | 83/347 |
| 3,765,329 | 10/1973 | Kirkpatrick et al. | 83/659 |
| 3,871,777 | 3/1975 | Sauer | 83/659 |
| 4,031,600 | 6/1977 | Whigham | 83/659 |
| 4,073,208 | 2/1978 | Kirkpatrick . | |
| 4,075,918 | 2/1978 | Sauer | 83/659 |
| 4,240,312 | 12/1980 | Ward, Sr. . | |
| 4,736,660 | 4/1988 | Benach et al. . | |
| 4,982,639 | 1/1991 | Kirkpatrick | 83/659 |
| 5,045,045 | 9/1991 | Davenport et al. | 83/659 |
| 5,076,128 | 12/1991 | O'Connor et al. . | |
| 5,078,535 | 1/1992 | Kirkpatrick | 83/659 |
| 5,613,546 | 3/1997 | Delassus et al. | 492/45 |

FOREIGN PATENT DOCUMENTS 0 818 285 A1 1/1998 European Pat. Off. .

OTHER PUBLICATIONS

Advertising brochure Montenegro date approximately Jun. 1997 (1 sheet).

Video tape R. Montenegro Die Cutting System Jun. 1, 1997 or earlier.

*Primary Examiner*—Kenneth E. Peterson
*Assistant Examiner*—Melissa Hall
*Attorney, Agent, or Firm*—Carella, Byrne, et al.; John G. Gilfillan, III; William Squire

[57] ABSTRACT

A circular cylindrical bearing section for a die cutter blanket comprises two segments pivoted relative to each other at one interface therebetween and resiliently urged radially apart by spring plungers at a second interface therebetween. A blanket section is wrapped about the two segments which are resiliently urged against the overlying blanket section secured to the bearing section by a conventional channel in the bearing and mating male-female interlocking members on the blanket. An array of bearing-blanket sections on an anvil roll are axially coupled by annularly spaced mating pins and notches at opposite axially facing edges of the bearing sections. The array of bearing-blanket sections are selectively slid as a unit along the anvil roll to rapidly relocate the blanket sections to minimize local blanket wear. The interlock members of each blanket section may be misaligned axially with the respect to the interlock members of the adjacent blanket sections.

27 Claims, 5 Drawing Sheets

DIE CUTTER BLANKET AND BEARING AND METHOD OF ARRANGING THE BLANKET AND BEARING ON AN ANVIL

This invention relates to rotary die cutter blanket bearings for use on a rotating anvil in a system for scoring moving sheets of material.

Rotary die cutting relates to cutting moving sheets of material such as cardboard and paperboard which are passed between a cutting roller and an anvil roller. Cutting rules are mounted on the cutting roller and rotate therewith. The anvil, typically a steel circular cylinder, is covered with a cutting die blanket of synthetic material typically urethane. The die blanket provides support for the sheets as the cutting rules penetrate through the sheets. As a result, the rules also penetrate somewhat into the surface of the blanket. This causes wear of the blanket. Such wear may eventually result in poor cutting by the rules in the local worn regions of the blanket.

Various solutions to the problem of wear of the blanket are employed in the prior art. In some cases, the blanket is provided in approximately one foot axial sections and in some instances may be wrapped about an intermediate layer referred to as a bearing, also of synthetic material such as polyurethane. The blanket is typically mounted to an axially extending slot in the anvil roll or in the bearing. The blanket, which may be provided in sections of the same axial extent as the bearing sections, is a one piece unit whose ends include interlocking male and female members for mating in the slot in either the bearing or anvil roll. A bolt may be used to lock the interlocked ends to the anvil roll or bearing.

For example, U.S. Pat. No. 5,076,128 to O'Conner et al. discloses a prior art construction having a bearing of hard polyurethane with a slot. A blanket cover of elastically deformable urethane has a metal liner with complementary latch members interlocked in the slot. This patent discloses an interlocking latch assembly for attaching a blanket cover to a bearing over an anvil roll.

U.S. Pat. No. 4,073,208 discloses an anvil structure including an anvil, a slip ring slidably mounted on the anvil head and a die blanket releaseably secured to the slip ring. The slip ring comprises a pair of half sections. The slip ring sliding engagement is limited to rotational movement relative to the anvil. Relative transverse movement in the axial direction is precluded by cooperating channels and shoulders in the anvil and slip ring. To remove the blanket from the slip ring requires the interlocked blanket ends to be disengaged.

U.S. Pat. No. 4,736,660 discloses a die roll including a resiliently covered anvil roll for die cutting carton blanks. The cover may be provided in sections or as one continuous cylinder. A gear mechanism provides a hunting ratio between the rolls to produce a more uniform wear of the anvil roll cover to prolong its effective life. This is costly and complex. The blanket interlocked ends need to be disengaged to remove the blanket from the anvil roll.

U.S. Pat. No. 4,240,312 to Ward discloses a method and apparatus for extending the useful life of covers on anvil rolls by causing the die cutting rules to penetrate the covers at sequential incremental small circumferentially spaced locations about the cover by adding to the speed of the rotation of the anvil roll relative to the speed of the die holder roll. Lateral reciprocation of the anvil roll is translated to rotary motion by a gear and pivot lever arrangement. The anvil cover is provide in a plurality of segments wherein the worn center segments are moved to the ends of the roll and the less worn segments at the ends are moved to the center.

The problem with this method of replacing the segments is that the interlock arrangement of each of the cover center and end segments needs to be removed and reattached later. This is time consuming and may take 30 minutes to an hour to accomplish. This causes the system to be down and not operating for such periods and is not desirable.

U.S. Pat. No. 3,577,822 discloses a still further cover and anvil roll arrangement.

In a further prior art system, slip bearing sections are provided along the anvil roll. Each bearing section comprises a cylinder with a cut through the bearing at one circumferential position, creating a split cylinder with abutting facing edges. The cylinder, because of the cut, is somewhat resilient in a tangential direction at the facing edges. A spring device at these edges resiliently urges the edges apart.

A blanket is wrapped about the bearing cylinder in conventional fashion. The bearing cylinder is resiliently urged against the cover. The cylinder has opposite annular edges facing in the axial direction. One edge has a lip and the other edge has a recess complementary to the lip. Eight to fourteen such bearing cylinders are mounted on an anvil roll. The lips of each bearing cylinder mates in the recess in the next adjacent bearing cylinder. Pins attach the mating cylinders at the abutting annular edges at the lips and recess. These pins extend radially toward the anvil roll axis and axially lock the sections together.

The attached bearing cylinders thus form a unitary elongated cylinder about the anvil roll. This elongated unitary cylinder acts as a single bearing cylinder and has relatively high friction with the anvil such that it is relatively fixed in place axially by the friction load, but may slip circumferentially about the anvil roll to provide more uniform blanket wear.

To axially retain the bearing cylinders on the anvil roll, one end bearing cylinder at one end of the anvil roll has a rib inwardly radially depending toward the anvil roll axis. This rib mates with an annular groove in the anvil roll. The engaged rib and anvil groove axially retain the joined plurality of bearing-blanket sections in place on the roll.

An axial groove is formed in the outer surface of the attached bearing cylinders. The blanket sections are then wrapped about the bearing cylinders, each blanket section corresponding to a bearing cylinder and attached by the mating male and female interlocks in a conventional manner.

The anvil roll and blanket assembly is then placed in a die cutting machine. To shuffle the blanket sections about to even the wear requires each blanket section to be removed from the corresponding bearing cylinder and relocated as desired. Typically four sections exhibit wear. In an eight section system, two end sections at opposite ends are relocated to the position of the center four sections. The center four sections are then relocated to the end locations, two sections at each end.

To remove the bearing cylinders from the anvil roll is difficult. This requires the entire anvil roll and bearing cylinder-blanket assembly to be removed from the die cutting machine with a crane or hoist. This is because the radial pins lock all of the bearing cylinders together so that the cylinders must removed as one unit by displacement axially from the anvil roll. In this way the combined bearing cylinders can then be axially removed from the ends of the freed anvil roll.

There is a relatively high friction load between the bearing cylinders and the anvil roll. To slide all of the bearing cylinders off the anvil roll as one piece to avoid disengaging the radial connecting pins requires special equipment. Also, the bearing cylinders can not be removed radially from the anvil roll as they can not be separated sufficiently at the single cut edge for this purpose. Therefore, the bearing cylinders can only be placed on or removed from the anvil roll when the anvil roll is removed from the die cutting machine. This is a time consuming and a costly process.

A problem is present with the latter arrangement where the one end section is fixed axially in place on the anvil roll due to the mating annular bearing rib and anvil roll groove. All of the seams between the mating sections are fixed axially in place. If a cutting rule is coincident with such seams, then the blanket provides insufficient support for the sheet at such seams and poor cuts may be produced in the sheet product. Such seams can not be relocated in this system.

A further problem is present when all of the blanket sections have axially aligned male and female interlocks. The outer peripheral blanket surface at these interlocks may be slightly out of round. This also affects the quality of the cuts on the sheet product.

A common problem with all of the above prior art systems is providing even wear. The full width of the machines are not used. The machines are set up to feed material centrally of the machine. The die cutters at the center experience most of the wear. Typically the center covers wear the most and the end covers exhibit negligible wear. To even out wear, all of the cover sections are typically removed, their positions shuffled, and reinstalled at new locations.

Such shuffling requires the relocation of removing and reinstalling eight to fourteen die cut covers (sections), either from the anvil roll directly or from the bearing cylinder sections. This shuffling of cover sections requires considerable down time since each cover interlock needs to be disengaged and reengaged.

Such relocation needs to be made at least every two weeks and in some instances as frequently as once a week. This requires unacceptable down time for the system as the blanket covers are removed to replace the worn covers. Even more down time is involved should the bearing cylinder sections need replacement.

Further, because the covers wear continuously during use, the quality of the cuts made by the rules deteriorates until the worn covers are replaced. The tendency in the industry is to extend the replacement for as long as possible to minimize such down time thereby extending the possible time that poor quality cuts are made.

The present inventor recognizes a need to provide an enhanced bearing-blanket cover arrangement which will minimize down time of the die cutting system when the worn covers need to be replaced. In particular, the present inventor recognizes that a blanket cover and bearing arrangement can be provided that can be moved individually in sections along the anvil without disengaging the central blanket covers interlocks to the underlying bearing sections. Further, the present inventor recognizes a need to remove bearing sections individually from the anvil roll without removing the anvil roll from the die cutting machine.

A die cutter blanket assembly according to the present invention is for use with a circular cylindrical anvil roll defining a longitudinal axis of rotation and having an outer peripheral surface of a given diameter. The assembly comprises a circular cylindrical bearing comprising first and second mating circular cylindrical segments each for selective independent radial placement about the anvil roll and a blanket wrapped about the bearing including interlock means for securing the blanket to the bearing.

One aspect of the present invention further includes retainer means for axially securing the bearing and blanket to the anvil roll.

Another aspect includes coupling means coupled to the bearing segments for resiliently urging the segments against the blanket.

In a still further aspect, the coupling means comprises means for biasing the bearing segments relative to each other at an interface therebetween.

In a further aspect, the first and second circular segments having corresponding first and second interfaces therebetween, the coupling means comprising resilient means secured to the first segment at the first interface for resiliently displacing the second segment at the first interface.

The coupling means may include pivot means coupled to the segments at the second interface and the pivot means may comprise a convex head secured to one of the first and second segments and a concave cavity for receiving the head in the other of the first and second segments at the second interface.

The bearing may have an inner diameter larger than the diameter of the anvil for providing a clearance therebetween.

A plurality of resilient plungers may be attached to the first segment in a further aspect for biasing the second segment away from the first segment about a pivot axis between the first and second segments.

Preferably, the first segment subtends an angle sufficiently large relative to the anvil roll diameter for radial snap fit attachment to the roll.

The segments may include an annular lip at one axial edge and a recess for receiving a lip identical to the annular lip in a still further aspect.

The bearing has opposite annular edges in an axial direction. The bearing may include a plurality of annularly spaced axially extending notches in one annular edge and a plurality of annularly spaced pins in the other annular edge for axially mating with notches identical to the plurality of notches.

A method of rearranging a die cutter blanket on an anvil roll comprises providing a plurality of blanket sections in an axial array on a cylindrical anvil roll wherein a first blanket section is at a first end of the array and a second blanket section is at a second opposite end of the array; removing the first section to provide an empty region at the first end; selectively displacing the array of remaining sections on the anvil roll including the second section along the anvil roll toward and to cover the empty region with a further section; and placing a blanket section on the anvil roll at the second end adjacent to the second section.

DETAILED DESCRIPTION

Figure 1:
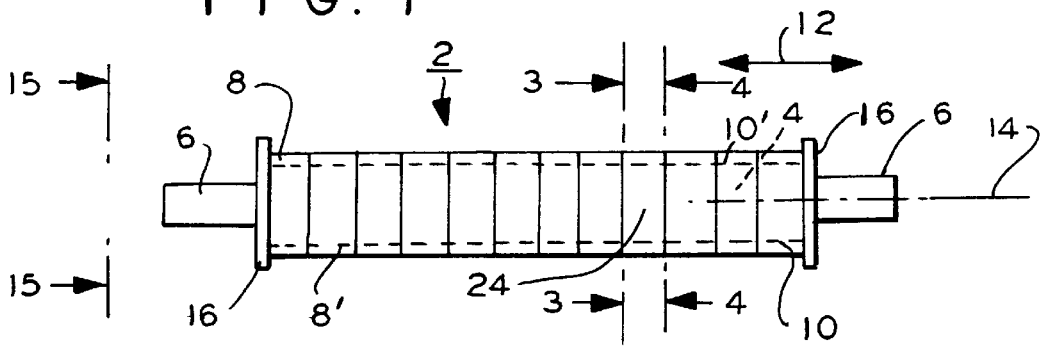
FIG. 1 is a side elevation view of a die cutter anvil roll and blanket assembly employing an array of bearing-blanket sections according to an embodiment of the present invention.

In FIG. 1, die cutter blanket and bearing assembly 2 is secured to a preferably steel circular cylindrical anvil roll 4 having end anvil roll bearings 6. The bearings 6 mount the roll 4 to a conventional roll drive in a conventional paperboard sheet cutting system (not shown). Assembly 2 comprises an axial array of identical abutting blanket-bearing sections 8, 10. More or fewer such sections may be provided in accordance with a given implementation, typically eight to fourteen sections.

Each section 8, 10 can be radially or axially mounted to and extends about the anvil roll 4. The blanket portions of the sections 8, 10 are conventional and include interlocking male and female members, such as members 28 and 30 (FIG. 12), at opposite blanket respective ends, such as ends 29, 29', of the blanket portions. Such interlocking members may be conventional. A particular interlocking arrangement 11 is disclosed in FIG. 12 and will be described below.

All of the sections 8, 10 are slidably attached to the anvil roll 4 for axial displacement in either of directions 12 along the longitudinal roll 4 axis 14. The sections 8, 10 are axially retained on the roll 4 by end retainers 16. The sections 8, 10 are manually slidable individually or in selected groups as desired without removing or attaching pins or as a unit along the anvil roll without disengaging or attaching any pins.

Figure 15:
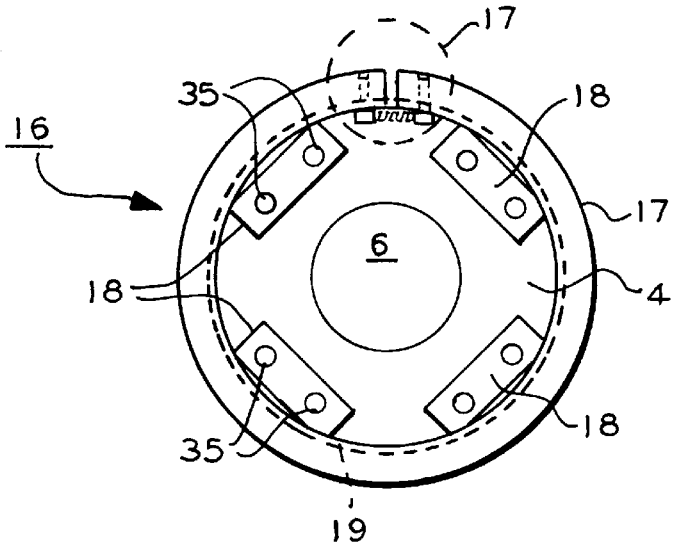
FIG. 15 is a side elevation view of the embodiment of FIG. 1 taken along lines 15—15.
Figure 16:
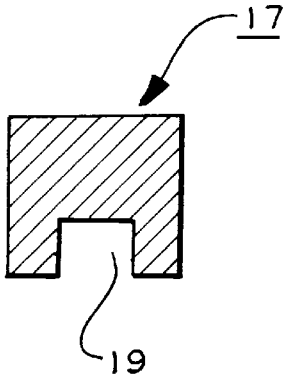
FIG. 16 is a sectional elevation view through the retainer of FIG. 2 taken along lines 16—16.
Figure 17:
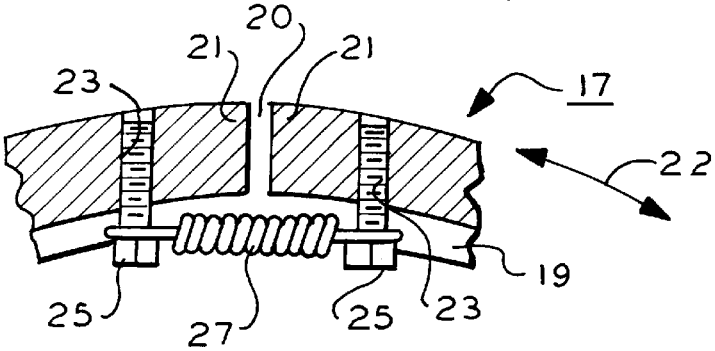
FIG. 17 is a more detailed sectional elevation view of the region 17 of FIG. 15.

The end retainers 16, FIG. 1, are identical. Representative retainer 16 comprises a ring 17 which may be steel, thermoset molded plastic or aluminum and preferably four retainer plates 18, also of steel, thermoset molded plastic or aluminum. In FIGS. 15–17, ring 17 is generally rectangular or square in cross section. The ring 17 has a radially inwardly facing annular slot 19. A cut 20 is formed through the ring 17 at one ring annular position. The cut ring 17 has facing ends 21 at the cut 20. Ring cut ends 21 are tangentially resilient relative to each other generally in directions 22.

A threaded radial bore 23 is in each end 21, the bores 23 receiving a screw 25. The screws 25 secure a tension coil spring 27 in slot 19 to and between the ends 21, the spring extending tangentially. The tension spring urges the ends 21 together opposite directions 22. The spring 27 and screws 25 are located in slot 19.

Figure 13:
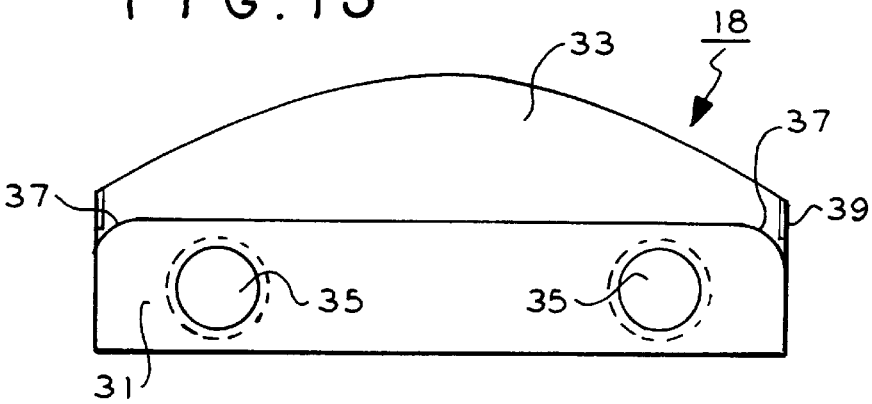
FIG. 13 a front elevation view of a retainer plate employed in the retainer of FIG. 2.
Figure 14:
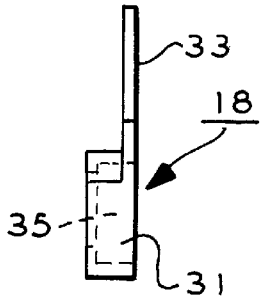
FIG. 14 is a side elevation view of the plate of FIG. 13.

In FIGS. 13–15, retainer plate 18 comprises a preferably rectangular in transverse section base 31 from which extends a relatively thinner flange 33. The flange 33 engages the slot 19 and is arcuate to mate with the curve of the slot 19. A pair of through bolt holes 35 are in the base 31. The base 31 abuts the ring 17 at arcuate end portions 37. A radius 39 is formed in the flange at the end portions 37.

Four plates 18, FIG. 15, are assembled to the ring 17 in equal annular spacings so that the bolt holes 35 are spaced to mate with corresponding bolt holes (not shown) in the end of the anvil roll 4. With the plates 18 so positioned and aligned with the anvil roll 4 bolt holes, the ring 17 is engaged with the flanges 33 of the plates 18.

It should be understood that numerous anvil configurations are available, not all of which have end bolt holes for a retainer. In some cases, the retainer may be fastened directly to the bearing section at the end of the anvil roll in the prior art. For such cases a different clamping arrangement is provided herein wherein annular clamps, to be described below, are attached to and about the anvil roll at each end to retain the bearing-blanket sections on the roll.

The annular array of holes 35 thus serve to secure the retainer 16 to the roll 4 by bolts (not shown). The retainer 16 ring 17 has a larger diameter than the sections 8, 10 for axially retaining the sections 8,10 on the roll 4.

Figure 3A:
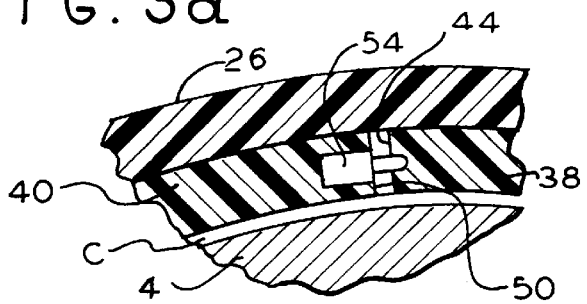
FIG. 3*a* is a more detailed sectional view of the region 3*a* of FIG. 3.
Figure 3:
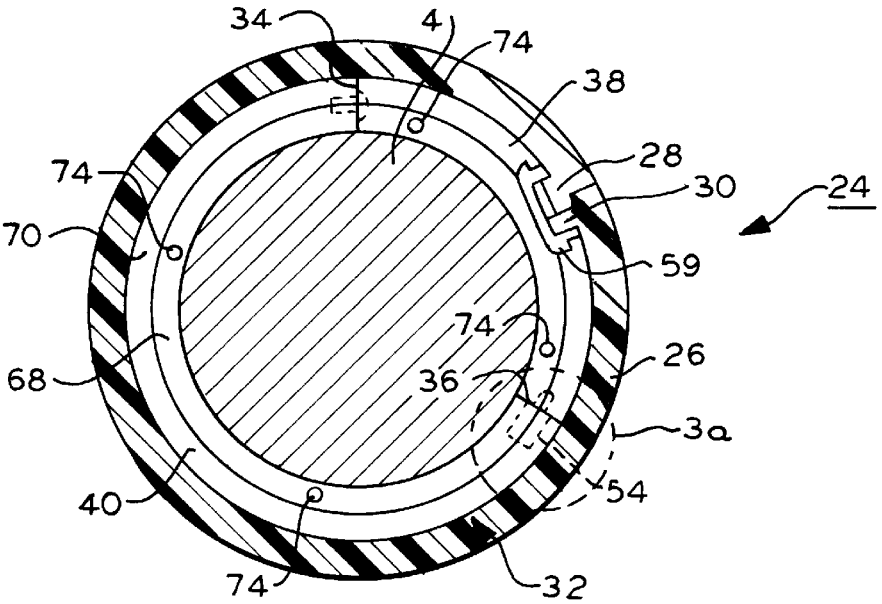
FIG. 3 is a sectional end elevation view of the embodiment of FIG. 1 taken along lines 3—3 showing a typical bearing-blanket section secured to an anvil roll.
Figure 4:
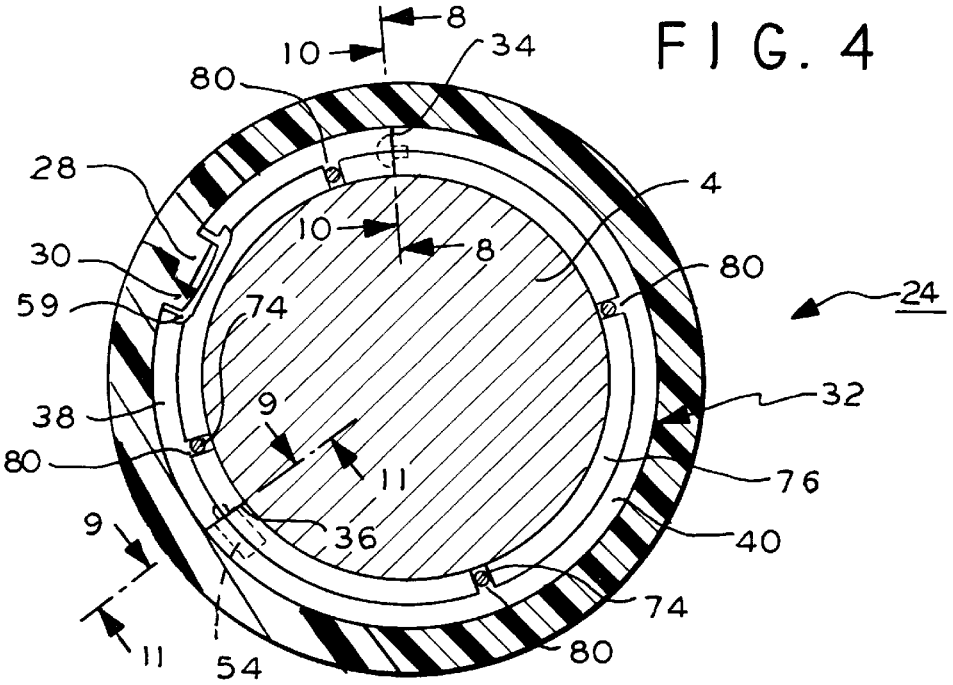
FIG. 4 is a sectional end elevation view of the embodiment of FIG. 1 taken along lines 4—4.

In FIGS. 3 and 4, representative blanket-bearing section 24 will be described, all of the sections being identical. Section 24 comprises a cover blanket 26 of conventional composite material which may include urethane. The blanket 26 has mating male and female members 28 and 30, of conventional design. A conventional metal liner, not shown, may also be attached to the blanket 26.

Bearing 32 is fabricated of molded polyurethane thermoset plastic. In the alternative, other known materials may be used for the bearing 32 as disclosed in the aforementioned patents in the introductory portion, incorporated by reference herein.

The bearing 32 is fabricated as a circular cylindrical ring having two saw cuts 34 and 36. The bearing 32 prior to the cuts 34 and 36 has an internal diameter larger than the external diameter of the anvil roll 4, e.g., 0.040 inches across the diameter of the roll. Because material is removed from the bearing at the saw cuts, the resulting internal diameter of bearing 32 is about the same as that of the roll 4 outer diameter with the two segments abutting.

Figure 8A:
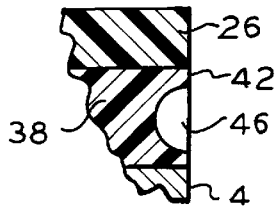
FIG. 8*a* is a sectional elevation view of the embodiment of FIG. 8 taken along lines 8*a*—8*a;*
Figure 8:
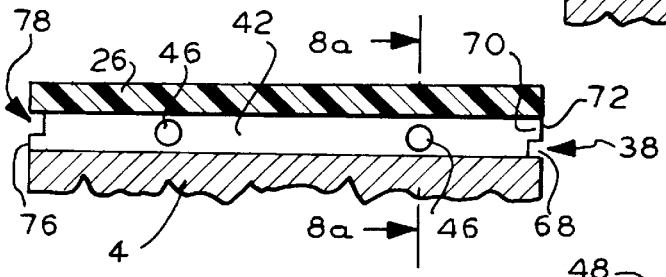
FIG. 8 is a sectional elevation view of the embodiment of FIG. 4 taken along lines 8—8.

The saw cuts 34 and 36 divide the bearing 32 into two circular segments 38 and 40. Segment 38 preferably subtends an angle of 123° and segment 40 subtends the complement angle of 237°. The segment 38, FIG. 8, has a planar transverse edge 42 at cut 34 (FIG. 4) and a planar transverse edge 44, FIG. 11, at cut 36 (FIG. 4). Edges 42 and 44 extend radially normal to the tangent to the corresponding segment. Edge 42, FIGS. 8 and 8a, has two like spaced segments of a sphere concave depressions 46. The opposite edge 44, FIG. 11, has two concave depressions 48.

Figure 10A:
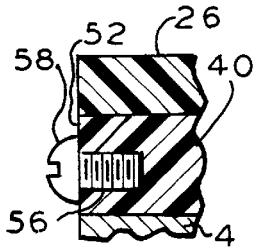
FIG. 10*a* is a sectional elevation view of the embodiment of FIG. 10 taken along lines 10*a*—10*a;*
Figure 10:
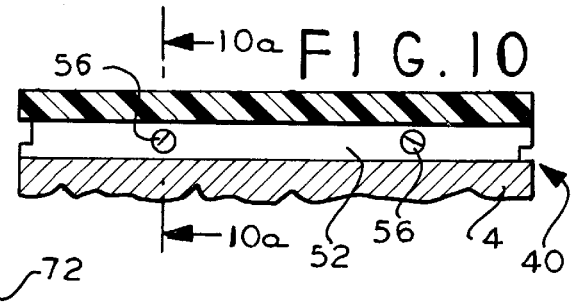
FIG. 10 is a sectional elevation view of the embodiment of FIG. 4 taken along lines 10—10.
Figure 9:
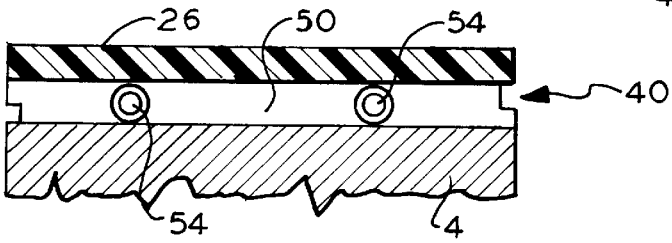
FIG. 9 is a sectional elevation view of the embodiment of FIG. 4 taken along lines 9—9.

Segment 40, FIG. 9, has a planar transverse edge 50 at cut 36 (FIG. 4) and a planar transverse edge 52, FIG. 10, at cut 34 (FIG. 4). Edges 50 and 52 extend radially normal to the tangent to the corresponding segment. Edge 50, FIG. 9, has two like spaced bores in each of which is disposed a plunger 54. The opposite edge 52, FIGS. 10 and 10*a*, has two spaced bores in each of which is disposed a round head screw 56 having a semispherical head 58. In FIGS. 3 and 4, segment 38 has a transverse channel 59 which is parallel to the anvil roll 4 axis 14, FIG. 1, when assembled to the roll 4.

Figure 7:
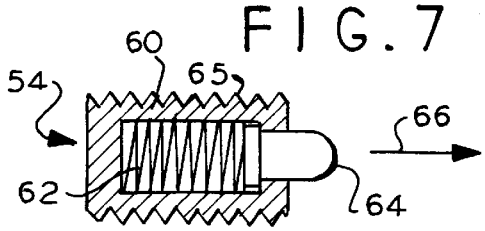
FIG. 7 is a side elevation sectional view of a plunger employed with the bearing sections in the embodiment of FIGS. 3*a*, 4 and 9.

In FIG. 7, plunger 54 comprises a metal cylindrical housing 60 having a chamber in which is disposed a compression spring 62. A cylindrical steel case hardened nose member 64 with a black oxide finish and a rounded tip is captured in the housing chamber by an annular flange and is resiliently urged out of the chamber by compression spring 62, direction 66. The spring exerts an initial force of about 6.6 pounds and a compressed force of about 17.4 pounds in this embodiment.

Plunger 54 may be a TE-CO Company, Union, Ohio, spring loaded plunger catalog number 52010. Plunger 54 has an external thread 65 for threading the plunger into the mating bore in the segment 40 edge 50, FIG. 9. The housing 60 may have a length of 1.25 inches and a ½-13 external thread 65. The nose member may be 0.25 inches in diameter and protrudes from the housing 60 a distance 0.25 inches. A nylon locking element (not shown or used) may be in the external thread 65 to lock the plunger 54 body 60 in the mating depression 48.

The plungers 54 have the same spacing in the segment 40 as the concave depressions 48 in the segment 38. The screws 56 have the same spacing in the segment 40 as the depressions 46 in the segment 38, the screws and the plungers preferably having the same spacing. In one embodiment by way of example, the bearing 32 has an axial width of about 10.25 inches, an outer diameter of about 20.37 inches and a thickness of 0.750 inches. In other embodiments, these dimensions may differ according to a given implementation.

Figure 5:
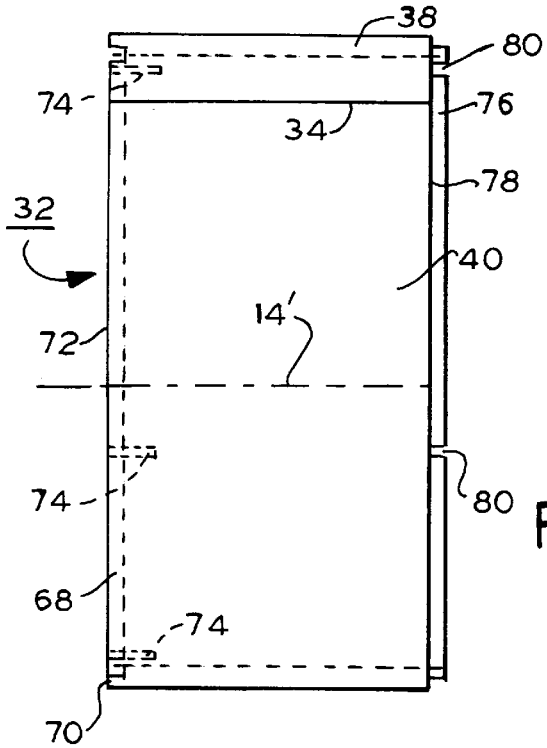
FIG. 5 is a side elevation view of a bearing section.

The coupled bearing 32 segments 38 and 40, FIGS. 3 and 5, each have a portion of an annular recess 68 forming an annular lip 70 at edge 72. A plurality, preferably four, annularly equally spaced guide pins 74 are threaded into corresponding bores in the bearing segments in the recess 68.

Figure 6:
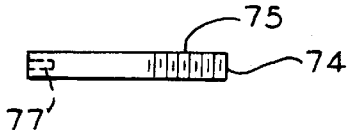
FIG. 6 is a side elevation view of a guide pin employed with the bearing sections in the embodiment of FIGS. 3 and 5.

In FIG. 6, the guide pins 74 are identical preferably steel rods with a threaded shank 75. A hex allen wrench receiving recess 77 is at the other end. The pins 74 may be fabricated from conventional allen type bolts whose heads are remove flush with the shank 75. The pins 74 are parallel to the axis 14, FIG. 1, and longitudinal axis 14' of the bearing 32 and are recessed in the recess 68. Two pins 74 are in each segment 38 and 40.

The bearing 32 has an annular lip 76 on the bearing edge 78 opposite edge 72. The lip 76 mates in the recess 68 when the bearings axially abut as in FIG. 1. A plurality, preferably four, of equally annularly spaced notches 80 are formed in lip 76. The notches 80 each closely receive and guide a guide pin 74 when the bearings 32 axially abut as in FIG. 1. The bearing segment 38 has an axially extending channel 59, FIGS. 3 and 4, for receiving an insert and the male and female locking members 28 and 30 of the blanket 26.

Figure 12:
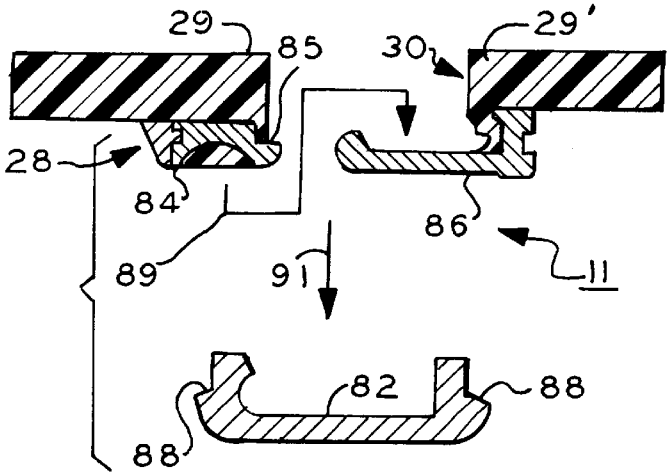
FIG. 12 is an exploded sectional elevation view of male-female interlocking members for locking a blanket to a bearing in each bearing-blanket section.

In FIG. 12, the interlocking arrangement 11 comprises a metal elongated U-shaped insert 82 which is in locking engagement with the bearing channel 59, FIGS. 3 and 4. The male member 28 has a male interlocking projection 84. The female member 30 comprises an L-shaped depending member 86. The male member 28 has a shoulder 85 which locks to an undercut shoulder in the female member in snap fit relation. The male member 28 is assembled to the female member 30 in the direction of the arrow 89 after the female member is inserted into the insert 82, direction 91. The insert is preassembled into the bearing channel 59 in interlocking engagement of shoulders 88 with mating shoulders in the bearing 32 channel 59.

In operation, in FIGS. 3 and 4, the bearing section comprising segments 38 and 40 are assembled about the anvil roll 4 to generally form a circular cylinder. The two screw heads 58, FIG. 10*a*, in segment 40 each mate in a corresponding depression 46 in segment 38, FIG. 8*a*. This engagement permits the segments 38 and 40 to pivot about the screw heads 58 which serve as a ball and socket with the depressions.

Figure 11:
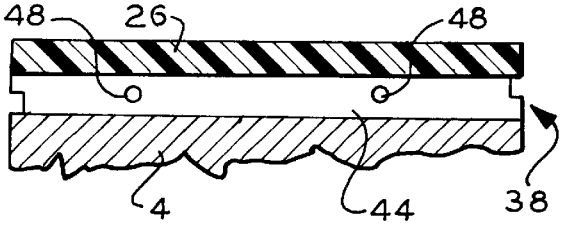
FIG. 11 is a sectional elevation view of the embodiment of FIG. 4 taken along lines 11—11.

The plungers 54 members 64 at the opposite segment edges, FIGS. 3 and 4, are compressively engaged with the concave depressions 48 (FIGS. 9 and 11). The blanket 26 is then wrapped about the segments 38 and 40 and its male member 28 and female member 30 locked to the channel 59 in a conventional manner via an insert in the channel.

When the blanket 26 is wrapped about and locked to the bearing 32, the plunger 54 members 64 (FIG. 7) are resiliently compressed against the spring 62. The spring 62 urges the two segments 38 and 40 apart in tangential directions normal to the anvil and blanket radii, such as directions 22, FIG. 17. This resilient loading of the segments 38 and 40 takes up the slack caused by the saw cuts 34 and 36 in the bearing 32. This action forces the bearing segments radially outwardly relative to the anvil roll axis 14.

In addition, this resilient loading of the segments creates a small clearance C, FIG. 3*a*, e.g., about 0.02 inches between the bearing and anvil roll 4 throughout the interface therebetween. This clearance C permits each of the bearing-blanket sections 8, 10 to be manually axially slid along axis 14, FIG. 1, without disassembly of the blanket 26 from the bearing 32.

At the same time, the resilient tangential loading by plunger 54 forces the bearing segments apart and radially compresses the bearing segments 38 and 40 against the outer wrapped blanket 26 providing a compressive fit therewith and imparts tension on the blanket 26. The two segments of each bearing section pivot at screws 56 and mating depressions 46.

While two plungers 54 are disclosed for performing the described functions, more or fewer plungers of differing spring force characteristics and dimensions may be provided according to a given implementation. In the alternative, the blanket may be assembled to the bearing 32 prior to assembly to the anvil roll 4.

However, preferably, the larger 237° segment 40 is attached to the anvil roll first. Because of its large angular extent relative to the anvil roll 4, the segment 40 is flexed and then snap fit over the anvil roll. Segment 40 is retained to the roll 4 by the snap fit. The other segment 38 is then placed against the anvil roll 4 to the position shown in FIGS. 3 and 4. Thus, the segments 38 and 40, because they are separate pieces, are each radially assembled to the anvil separately, i.e., independently of each other. The segment 40 is oriented so that segment 38 is placed on top of the roll. If placed underneath the roll, gravity may cause segment 38 to fall off. Therefore, all of the bearing segments of each section may be placed on or removed from an anvil roll while it is attached to its drive mechanism in the die cutting system.

With all of the bearing-blanket sections 8, 10 assembled to the roll 4, FIG. 1, and axially interengaged by pins 74 and notches 80, FIG. 5, the sections are then axially locked in place by retainers 16. The retainers 16 are each bolted via their bolt holes 35, FIG. 15, to the anvil roll 4 at opposite roll ends as shown in FIG. 1.

The sections 8, 10 are all interlocked rotationally relative to each other about the axis 14 by way of the axially engaged pins 74, FIG. 5, and notches 80. This axially interlocked relation forms an effectively unitary cylinder which operates as one unit. Any rotational slippage is transferred to all such sections wherein the sections may rotate relative to the anvil roll during use. The blanket and bearing sections exhibit some friction with the anvil roll 4, but considerably less than in the prior art.

The pins and notches axially align along axis 14 all of the sections 8, 10. This permits the sections to be manually axially slid along the anvil roll relative to each other if desired. The prior art sections could not be so moved manually and need the aid of special equipment.

The channels 59 and male and female members 28, 30 may be axially aligned in one relative orientation. However, such alignment is not essential. The various sections are may be assembled at different angular orientations relative to the other sections 8, 10 in the array. This misaligns the male and female interlocking members 28 and 30 in relatively different angular orientations.

Such different relative angular orientations about the anvil roll axis provides more uniform blanket wear. This is to accommodate the out of round condition at the blanket interlock members as discussed in the introductory portion. These different orientations are possible because the pins 74 and mating notches 80 are spaced equally about the segments 38 and 40. Each bearing segment is provided with a pair of such pins and notches as shown in FIG. 4.

Figure 1A:
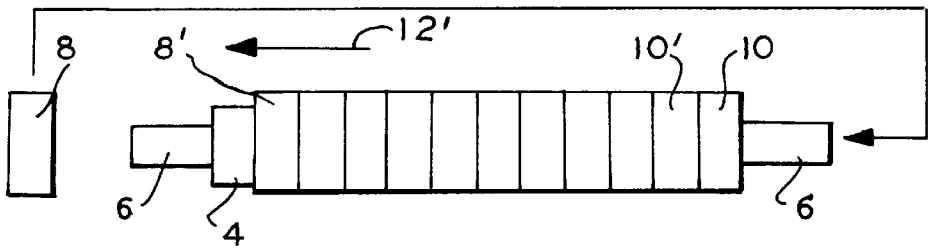
FIGS. 1*a* and 1*b* are side elevation views of the assembly of FIG. 1 in subsequent stages of changing the position of the bearing-blanket sections.

In FIG. 1, the retainers 16 preferably comprise a relatively flexible resilient polyurethane ring 17. This ring is relatively flexible as compared to a metal ring. In FIG. 1*a*, to relocate the bearing-blanket sections 8, 10, only the rings 17 need to be removed from the anvil roll 4 to provide clearance for the removal of section 8. The rings are removed by spreading them apart at cut 20 (FIG. 17) and then disengaging them from the flanges 33 of the plates 18 . Plates 18 remain attached to the roll 4.

The end bearing-blanket section 8 is removed from the anvil roll 4. The section 8 is removed by first unlocking the interlocked male and female members of its blanket. This permits the bearing segments 38 and 40 of section 8 to be radially removed from the anvil roll 4.

The smaller segment 38 is radially removed first. The larger segment 40, because of its angular extent, remains attached to the roll 4 because it subtends a relatively large angle. It can be radially removed by flexing it apart somewhat to radially pass it over the roll 4. Because both the blanket and bearing sections can be radially removed from the anvil roll, the anvil roll can remain attached to the die cutting drive system.

The remaining sections 8', 10' are then manually slid along the anvil roll 4 in direction 12', generally in groups or individually since their notches 80 readily engage and disengage the pins 74 axially without removing the bearingblanket sections from the anvil roll 4. The end retainer 16 next adjacent to the section 8' is reattached to the anvil roll 4 and the section 8' displaced into abutment with the retainer 16 at this end.

Figure 1B:
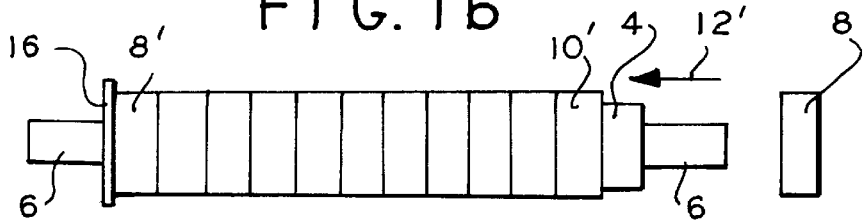
Figure 2:
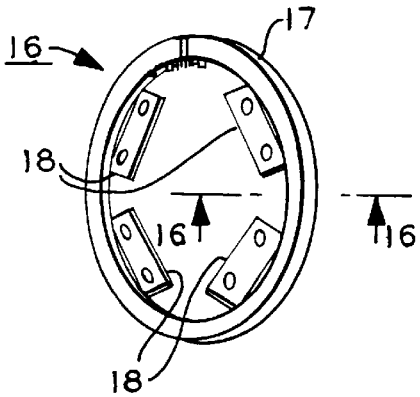
FIG. 2 is an isometric view of a retainer used to hold the bearing-blanket sections in place in the embodiment of FIG. 1.

Section 8 is then reattached to the anvil roll 4 at the roll opposite end, FIG. 1*b*. The section 8 is reattached radially in the reverse of its removal from the other anvil roll end. In the alternative, it could be reassembled and then slid along the roll 4. In any case, the pins 74 of section 8 are engaged with the mating notches 80 of the next adjacent section 10 which at this time has been relocated axially one section in direction 12'.

The retainer 16 ring 17 for this end of the roll 4 is reattached to the roll 4. This entire process of removing the section 8 and replacing to the roll 4 opposite end takes 5–10 minutes as compared to up to an hour or more for prior art changing of all of the blanket sections.

It is a much more time consuming operation to disassemble the male and female interlocked members from a mating channel for each of the eight to fourteen blanket sections to be moved in the prior art arrangements. In comparison, in the present invention, the retainer rings 17 are merely spread apart manually to be removed. In the alternative using more rigid metal rings 17 requires the removal of a few bolts.

Then section 8 is removed radially and the remaining bearing-blanket sections are slid manually axially individually or in groups as desired along axis 14 replacing section 8 with a new section 8' and displacing all remaining sections.

This process is completed relatively rapidly. Except for the single end section 8 which can be attached and removed relatively quickly, no unlocking of the male-female members to the channel is required. Only one end section 8 need be removed from the anvil roll for relocation to the opposite end. This end section is easily removed from the anvil roll and relocated to the other anvil roll end. Further, the anvil roll need not be removed from the die cutting drive system with a hoist. This is in comparison to the need for the more difficult removal of the anvil roll from the drive system and the relocation of the eight to fourteen sections in the prior art requiring the unlocking of each blanket section from its bearing locking channel.

Thus, the bearing-blanket sections preferably may be relocated once to three times daily as compared to once a week or every other week in the prior art. This more frequent relocation of the blankets provides more even wear of the blankets and higher quality product.

The bearing sections by way of the mating lips and recesses at their edges and the engaged pins and notches form essentially a single sleeve. This sleeve forms a rotating slip surface over the anvil roll 4, and at the same time accommodates the mounting of the die cutter blankets. As the blankets wear, the effective diameter of the cylinder formed thereby becomes smaller, affecting the length of the sheet being cut, and the resulting boxes being fabricated on that cutting surface.

The slippage of the bearing-blanket cylinder provides speed compensation on the cutting surface of the blankets. This in turn produces a more uniform box length, for example, for boxes produced by the sheet of material being processed. This more uniform box length is produced over the life of the die cutting blankets.

Figure 18:
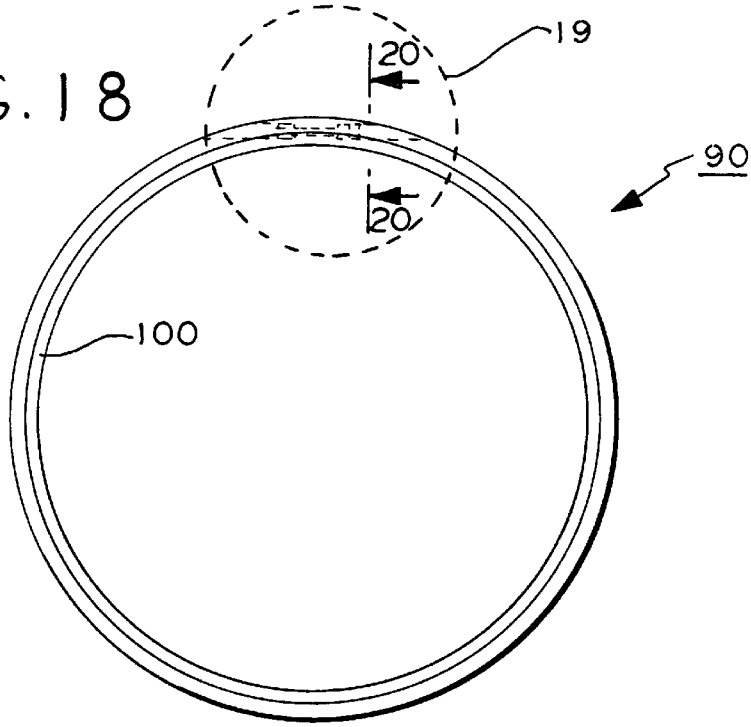
FIG. 18 is a side elevation view of a clamp for use with the bearing-blanket sections of the embodiment of FIG. 1.
Figure 19:
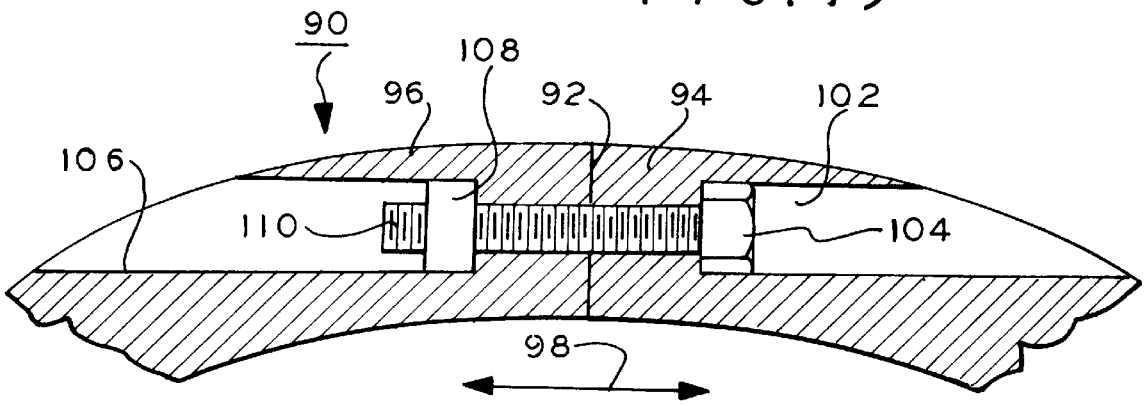
FIG. 19 is a sectional elevation view of the embodiment of FIG. 18 taken at region 19.
Figure 20:
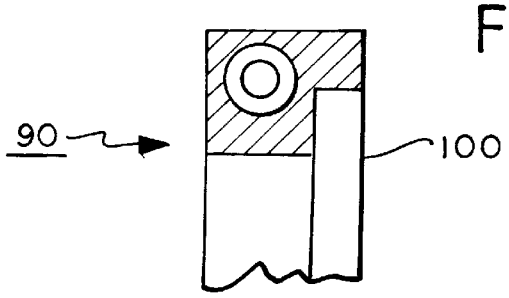
FIG. 20 is a transverse sectional elevation view of the embodiment of FIG. 18 taken along lines 20—20.

In an alternative embodiment, FIGS. 18–20, a clamp retainer ring 90 may be provided in place of one or both of retainers 16, FIG. 1. Ring 90 is a circular cylinder, preferably steel, having a through cut 92, providing a split resilient ring. End portion 94 is resilient in directions 98 relative to facing abutting end portion 96. Ring 90, FIG. 20, has an annular recess 100. Recess 100 receives lip 76, FIG. 5, of bearing 32.

In FIG. 19, portion 94 has a countersunk bolt hole 102 for receiving bolt 104. Portion 96 has a countersunk bolt hole 106 for receiving a threaded insert 108 fixed in bore 106 (or a nut) and the bolt 104 threaded shank 110. The clamped inner diameter of the ring, FIGS. 18 and 19, is smaller than the outer diameter of the anvil roll 4, FIG. 1. When the bolt 104 is tightened as shown in FIG. 19, the ring 90 is fixedly clamped to the anvil roll. With the bearing-blanket sections in place on the roll 4, the sections are fixed axially. A ring 90 need be used at only one roll 4 end but two such rings may be used if desired at opposite ends. This depends upon a given implementation and the axial widths of the blanket sections employed.

The clamp rings 90 on the anvil roll 4 at the roll ends are employed in place of the sections 8 and 10 at a desired location on the roll 4. The remaining sections can be relocated axially predetermined distances from the roll end. These distances are set a fraction of the axial length of a bearing-blanket section. This permits the sections to be axially relocated to align the cutting rules with the blankets at regions between the seams of the adjacent abutting sections when needed.

If only one clamp ring 90 is employed, then a bearing-blanket section needs to be provided which has a different axial width than the remaining sections. This allows for the seams to be relocated and accommodate the resulting different spacing at the end of the anvil roll 4 employing a retainer ring 16. Such non-uniform widths of the bearing-blanket sections is not as desirable to minimize odd size elements. Therefore, two retaining clamp rings 90 are preferred when used.

The ring 90 at the other end abuts the last bearing blanket section in the array to axially lock the array to the anvil roll 4 to the second ring 90.

It will occur to one of ordinary skill that various modifications may be made to the disclosed embodiments which are given by way of example and not limitation. The scope of the invention is as defined in the appended claims.

For example, spring loaded plungers may be provided at each of the bearing segment interfaces. The screws at the pivot edges of the bearing segments are optional. Other pivot devices may be used in the alternative, such as a rod extending along one segment edge for mating in a groove in the other facing segment edge. The segments may be formed with integral one piece pivot members at their mating interfaces. Leaf springs may be provided in place of compression coil springs. Also, elastomeric resilient material may be used in the alternative to the plungers.

There thus has been shown and described a bearing comprising two mating segments which pivot relative to each other and are urged resiliently radially outwardly by a tangential resilient force between the bearing segments at an interface therebetween. Pivot devices are provided at a second interface between the two segments.

While two bearing segments are shown, more than two segments may be used. The segments are readily removed radially from the anvil roll. The segments and blankets in the intermediate region between the end sections can be easily manually axially displaced as a unit or separated as needed axially at any desired location among the intermediate sections.

For example, a center bearing-blanket section may be radially removed by axially displacing the next one or both adjacent sections slightly to radially free the mating lips and recesses and pins. Any axial displacement of course requires the removal of at least one of the retainers at the end of the anvil roll.

In a further alternative, bearing-blanket sections may be provided with different axial widths. Such sections may be selectively provided at the end of the anvil roll or other locations to displace the seams of adjacent blanket sections relative to the die cutting rules.

What is claimed is:

1. A die cutter blanket assembly for use with a circular cylindrical anvil roll defining a longitudinal axis of rotation and having an outer peripheral surface of a given diameter, the assembly comprising:

a circular cylindrical blanket bearing comprising first and second mating circular cylindrical segments each for selective independent placement about the anvil roll, said blanket bearing being arranged for relative rotation about the anvil roll;

an integral unitary blanket wrapped about the bearing including interlock means for securing the blanket to the bearing, and coupling means coupled to the bearing segments for resiliently urging the segments against the blanket.

2. The assembly of claim 1 further including retainer means for axially securing the bearing and blanket to the anvil roll.

3. The assembly of claim 1 wherein the coupling means comprises means for biasing the bearing segments relative to each other at an interface therebetween.

4. The assembly of claim 1 wherein the first and second circular segments having corresponding first and second interfaces therebetween, the coupling means comprising resilient means secured to said first segment at said first interface for resiliently displacing the second segment at said first interface.

5. The assembly of claim 4 wherein the coupling means include pivot means coupled to said segments at said second interface.

6. The assembly of claim 5 wherein the pivot means comprises a convex head secured to one of the first and second segments and a concave cavity for receiving the head in the other of said first and second segments at the second interface.

7. The assembly of claim 1 wherein said bearing has an inner diameter larger than the diameter of said anvil roll for providing a clearance therebetween.

8. The assembly of claim 1 including a plurality of resilient plungers attached to the first segment for biasing the second segment away from the first segment about a pivot axis between the first and second segments.

9. The assembly of claim 1 wherein the first segment subtends an angle sufficiently large relative to the anvil roll diameter for radial snap fit attachment to the roll.

10. The assembly of claim 1 wherein said segments include an annular lip at one axial edge and a recess at a second axial edge for receiving a lip identical to the annular lip.

11. The assembly of claim 1 wherein the bearing has opposite annular edges in an axial direction, said bearing including a plurality of annularly spaced axially extending notches in one annular edge and a plurality of annularly spaced pins in the other annular edge for axially mating with notches identical to said plurality of notches.

12. A die cutter blanket bearing for use with a circular cylindrical anvil roll defining a longitudinal axis of rotation and having an outer peripheral surface, the bearing for receiving a circular cylindrical unitary integral elongated blanket wrapped thereabout, the blanket including an interlock at its ends for locking the blanket to the bearing, the bearing comprising:

a first circular cylindrical segment having an outer peripheral surface for receiving a first portion of the circular cylindrical blanket wrapped thereabout;

a second circular cylindrical segment for forming a circular cylinder with the first segment and defining a longitudinal axis with the first segment, said second segment for receiving thereabout a second portion of the wrapped blanket, said first and second segments for selective axial manual displacement along the anvil roll peripheral surface and for selective removal from the anvil roll, at least one of said segments including interlock means for receiving and engaging the blanket interlock to secure the blanket about the segments;

resilient means for urging said segments radially outwardly; and resilient means for urging said segments radially outwardly.

13. The bearing of claim 12 wherein the segments have first and second interfaces therebetween, the means for resiliently urging including spring means secured to the first segment at said first interface for resiliently engaging the second segment at said first interface.

14. The bearing of claim 13 including pivot means coupled to said segments at the second interface for permitting the segments to pivot radially outwardly in response to said resilient urging.

15. The bearing of claim 12 further including an array of said bearings extending along said longitudinal axis wherein said first and second segments of each bearing of the array have first and second opposing annular rims, the first rim having a plurality of annularly spaced recesses and the second rim having a plurality of annularly spaced guide pins, each recess for receiving a guide pin of a next adjacent segment in the array.

16. The bearing of claim 15 wherein the segments include a lip projecting axially in the direction of the longitudinal axis from the first rim, the recesses each comprising a notch in said lip, the second rim having an annular recess for receiving a lip from an axially next adjacent bearing.

17. The bearing of claim 15 wherein the first and second segments of a bearing of the array each abut a portion of each of the respective first and second segments of the next adjacent bearing.

18. The bearing of claim 12 wherein the segments are in abutting relation with each other at respective first and second interfaces therebetween and including means for resiliently urging the segments radially outwardly to provide an annular radial clearance between the segments and the anvil roll.

19. A method of rearranging a die cutter blanket on an anvil roll comprising:

providing a plurality of blanket sections in an axial array on a cylindrical anvil roll wherein a first blanket section is at a first end of the array and a second blanket section is at a second opposite end of the array;

removing the first blanket section to provide an empty region at the first end;

axially displacing the array of remaining blanket sections on the anvil roll including the second blanket section along the anvil roll toward and to cover the empty region with a further blanket section and to create a further empty region at the second end;

placing the first blanket section on the anvil roll to cover the further empty region at the second end adjacent to the second blanket section; and providing each bearing section with mating first and second circular cylindrical segments, and resiliently radially outwardly pivoting each bearing segment at a pivot joint for resiliently urging the cylindrical segments radially outwardly against the overlying corresponding blanket section.

20. The method of claim 19 including providing a plurality of bearing sections about the anvil roll, each bearing section corresponding to a blanket section wrapped thereabout, said removing step including removing a bearing section simultaneously with its corresponding blanket section.

21. The method of claim 20 wherein the displacing step includes displacing the bearing sections on the anvil roll simultaneously with the corresponding blanket sections.

22. A die cutter blanket assembly for use with a circular cylindrical anvil roll defining a longitudinal axis of rotation and having an outer peripheral surface of a given diameter, the assembly comprising:

a circular cylindrical blanket bearing comprising first and second mating circular cylindrical segments each for selective independent radial placement about the anvil roll; and a blanket wrapped about the bearing including interlock means for securing the blanket to the bearing including coupling means coupled to the bearing segments for resiliently urging the segments against the blanket, the first and second circular segments having corresponding first and second interfaces therebetween, the coupling means comprising resilient means secured to said first segment at said first interface for resiliently displacing the second segment at said first interface.

23. A die cutter blanket assembly for use with a circular cylindrical anvil roll defining a longitudinal axis of rotation and having an outer peripheral surface of a given diameter, the assembly comprising:

a circular cylindrical blanket bearing comprising first and second mating circular cylindrical segments each for selective independent radial placement about the anvil roll;

a blanket wrapped about the bearing including interlock means for securing the blanket to the bearing; and a plurality of resilient plungers attached to the first segment for biasing the second segment away from the first segment about a pivot axis between the first and second segments.

24. A die cutter blanket bearing for use with a circular cylindrical anvil roll defining a longitudinal axis of rotation and having an outer peripheral surface, the bearing comprising:

a first circular cylindrical segment having an outer peripheral surface for receiving a first portion of a circular cylindrical blanket wrapped thereabout; and a second circular cylindrical segment for forming a circular cylinder with the first segment and defining a longitudinal axis with the first segment, said second segment for receiving thereabout a second portion of the wrapped blanket, said first and second segments for selective axial manual displacement along the anvil roll peripheral surface and for selective radial removal from the anvil roll, the segments having first and second interfaces therebetween; and resilient means for urging said segments radially outwardly including spring means secured to the first segment at said first interface for resiliently engaging the second segment at said first interface.

25. A die cutter blanket bearing array for use with a circular cylindrical anvil roll defining a longitudinal axis of rotation and having an outer peripheral surface, the bearing array comprising:

a plurality of bearings, each bearing comprising:

a first circular cylindrical segment having an outer peripheral surface for receiving a first portion of a circular cylindrical blanket wrapped thereabout;

a second circular cylindrical segment for forming a circular cylinder with the first segment and defining a longitudinal axis with the first segment, said second segment for receiving thereabout a second portion of the wrapped blanket, said first and second segments for selective axial manual displacement along the anvil roll peripheral surface and for selective radial removal from the anvil roll;

the array of said bearings extending along said longitudinal axis wherein said first and second segments of each bearing of the array have first and second opposing annular rims, the first rim having a plurality of annularly spaced recesses and the second rim having a plurality of annularly spaced guide pins, each recess for receiving a guide pin of a next adjacent segment in the array, the first and second segments of a bearing of the array each abutting a portion of each of the respective first and second segments of the next adjacent bearing.

26. A die cutter blanket bearing for use with a circular cylindrical anvil roll defining a longitudinal axis of rotation and having an outer peripheral surface, the bearing comprising:

a first circular cylindrical segment having an outer peripheral surface for receiving a first portion of a circular cylindrical blanket wrapped thereabout; and a second circular cylindrical segment for forming a circular cylinder with the first segment and defining a longitudinal axis with the first segment, said second segment for receiving thereabout a second portion of the wrapped blanket, said first and second segments for selective attachment to the anvil roll peripheral surface;

the segments for being in abutting relation with each other at respective first and second interfaces therebetween and including means coupled to the bearing segments for resiliently urging the segments radially outwardly, the abutting segments being dimensioned relative to the anvil roll for rotation relative to the anvil roll.

27. A die cutter blanket assembly for use with a circular cylindrical anvil roll defining a longitudinal axis of rotation and having an outer peripheral surface of a given diameter, the assembly comprising:

a circular cylindrical blanket bearing comprising first and second mating circular cylindrical segments each for selective independent placement about the anvil roll, said blanket bearing being arranged for relative rotation about the anvil roll; and an integral unitary blanket wrapped about the bearing including interlock means for securing the blanket to the bearing, said bearing having an inner diameter larger than the diameter of said anvil roll for providing a clearance therebetween.

* * * * *